US007596236B2

(12) United States Patent
Vincenot

(10) Patent No.: US 7,596,236 B2
(45) Date of Patent: Sep. 29, 2009

(54) LOUDSPEAKER WITH DIRECT EMISSION AND OPTIMISED RADIATION

(75) Inventor: Eric Vincenot, Paris (FR)

(73) Assignee: Nexo, Villepinte (FR)

( * ) Notice: Subject to any disclaimer, the term of this patent is extended or adjusted under 35 U.S.C. 154(b) by 212 days.

(21) Appl. No.: 10/484,464

(22) PCT Filed: Jul. 22, 2002

(86) PCT No.: PCT/FR02/02615

§ 371 (c)(1),
(2), (4) Date: Jan. 22, 2004

(87) PCT Pub. No.: WO03/010994

PCT Pub. Date: Feb. 6, 2003

(65) Prior Publication Data

US 2004/0170292 A1 Sep. 2, 2004

(30) Foreign Application Priority Data

Jul. 23, 2001 (FR) ..... 01 09799

(51) Int. Cl.
*H04R 25/00* (2006.01)

(52) U.S. Cl. ..... 381/160; 381/350; 181/191

(58) Field of Classification Search ..... 381/337, 381/339, 346–347, 160; 181/155–156, 175
See application file for complete search history.

(56) References Cited

U.S. PATENT DOCUMENTS

| | | | | |
|---|---|---|---|---|
| 3,912,866 | A * | 10/1975 | Fox | 381/352 |
| 4,907,671 | A * | 3/1990 | Wiley | 181/155 |
| 5,115,882 | A * | 5/1992 | Woody | 181/144 |
| 5,673,329 | A * | 9/1997 | Wiener | 381/160 |
| 5,886,304 | A * | 3/1999 | Schlenzig et al. | 181/155 |
| 5,943,430 | A * | 8/1999 | Saitoh | 381/160 |
| 6,257,365 | B1 * | 7/2001 | Hulsebus, II | 181/155 |
| 6,738,483 | B1 * | 5/2004 | Betts | 381/160 |
| 2003/0174851 | A1 * | 9/2003 | Plummer | 381/339 |
| 2004/0071298 | A1 * | 4/2004 | Geeng | 381/89 |

FOREIGN PATENT DOCUMENTS

| | | |
|---|---|---|
| DE | 42 11 114 | 10/1993 |
| GB | 2 027 320 | 2/1980 |
| JP | 47-41826 | 12/1972 |
| JP | 4741826 | 12/1972 |
| JP | 9093685 | 11/1995 |
| JP | 9-93685 | 4/1997 |
| WO | WO 9620576 | 11/1995 |
| WO | WO 96/20576 | 7/1996 |

OTHER PUBLICATIONS

Patent Abstracts of Japan, vol. 013, No. 548 (E-856), Dec. 7, 1989 -& JP 01 226298 A (Matsushita Electric Ind Co Ltd), Sep. 8, 1989 abstract.

* cited by examiner

*Primary Examiner*—Curtis Kuntz
*Assistant Examiner*—Phylesha Dabney
(74) *Attorney, Agent, or Firm*—Young & Thompson

(57) ABSTRACT

The invention concerns a mobile membrane loudspeaker equipped with a partial closure optimising its radiation. The invention is characterised in that the loudspeaker with mobile diaphragm (19) attached to a rigid frame (15) defining an acoustic emission plane (P) comprises a closure (25) for only one central zone of said emission plane.

26 Claims, 3 Drawing Sheets

LOUDSPEAKER WITH DIRECT EMISSION AND OPTIMISED RADIATION

BACKGROUND OF THE INVENTION

1. Field of the Invention

The invention relates to a direct radiation loudspeaker of the type conventionally comprising a mobile diaphragm attached by its outside edge to a rigid chassis forming a frame. It relates more particularly to an improvement for adapting the directionality of this kind of loudspeaker and more particularly for reproducing the directionality of a rectangular piston. One benefit of the invention lies in the fact that adapting the directionality of this kind of loudspeaker eliminates interference over an extended range of frequencies and thus enables a plurality of direct radiation loudspeakers to be coupled together.

2. Description of the Related Art

A conventional direct radiation loudspeaker comprises a mobile diaphragm that is relatively rigid and light in weight and has a conical, exponential or other cross section, at the center of which is mounted a coil adapted to move inside a magnetic field generated by a magnet. The mobile diaphragm is attached by its outside edge to a rigid chassis forming a frame which also supports the magnet. The frame coincides with a plane that is referred to hereinafter as the acoustic emission plane, beyond which sound propagates in the external medium. This kind of loudspeaker is one of the most widely used components in the art of sound reinforcement. An electrical signal representative of the sound to be reproduced is applied to the terminals of the coil, which moves in the airgap of the magnet. This movement entrains the diaphragm, which radiates acoustic energy toward the external medium, beyond said acoustic emission plane. This kind of loudspeaker has the following characteristics:

- if the contour of the frame defined above is circular, the acoustic radiation from the loudspeaker is axisymmetrical, i.e. identical in all planes containing the axis of the loudspeaker, which is also the axis of the mobile coil.
- The dispersion of the loudspeaker decreases as the frequency increases.

SUMMARY OF THE INVENTION

The invention proposes an accessory designed to be fixed to this kind of loudspeaker to modify its characteristics as a function of specific requirements related to the design of the acoustic enclosure, at least for a certain range of frequencies.

To this end, the invention consists in a direct radiation loudspeaker comprising a mobile diaphragm attached by its outside edge to a rigid chassis forming a frame defining an acoustic emission plane, characterized in that it further includes a blocking member for blocking only a central region of said emission plane within said frame.

Thus the blocking member is positioned in front of a portion of the front face of the loudspeaker. It is mechanically fixed to the chassis or to a part fastened thereto. The fixing means are conventional nuts and bolts, etc.

The shape of the blocking member generally depends on the results required. Generally speaking, however, the blocking member is placed along a diameter or an axis of symmetry of the frame and typically covers between one third and one half of the front surface of said frame, leaving open two equal portions of said acoustic emission plane, symmetrical with respect to an axis of symmetry of the blocking member.

In a preferred embodiment, the blocking member is made from a material, possibly a composite material, that is sufficiently rigid not to vibrate. It can be made from a plastics material or from wood, for example. It generally has at least one first plane of symmetry containing an axis of the diaphragm and preferably has a second plane of symmetry containing the axis of the diaphragm and perpendicular to said first plane of symmetry. Its rear face, i.e. that facing toward the diaphragm of the loudspeaker, is preferably profiled. Said rear face can be globally convex, for example, so as to fit into the space defined between the diaphragm and the acoustic emission plane.

BRIEF DESCRIPTION OF THE DRAWINGS

The invention will be understood better and other advantages of the invention will become more clearly apparent in the light of the following description of embodiments of a direct radiation loudspeaker fitted with a directionality adapter conforming to the invention, which description is given by way of example only and with reference to the appended drawings, in which.

DESCRIPTION OF THE PREFERRED EMBODIMENTS

Figure 1:
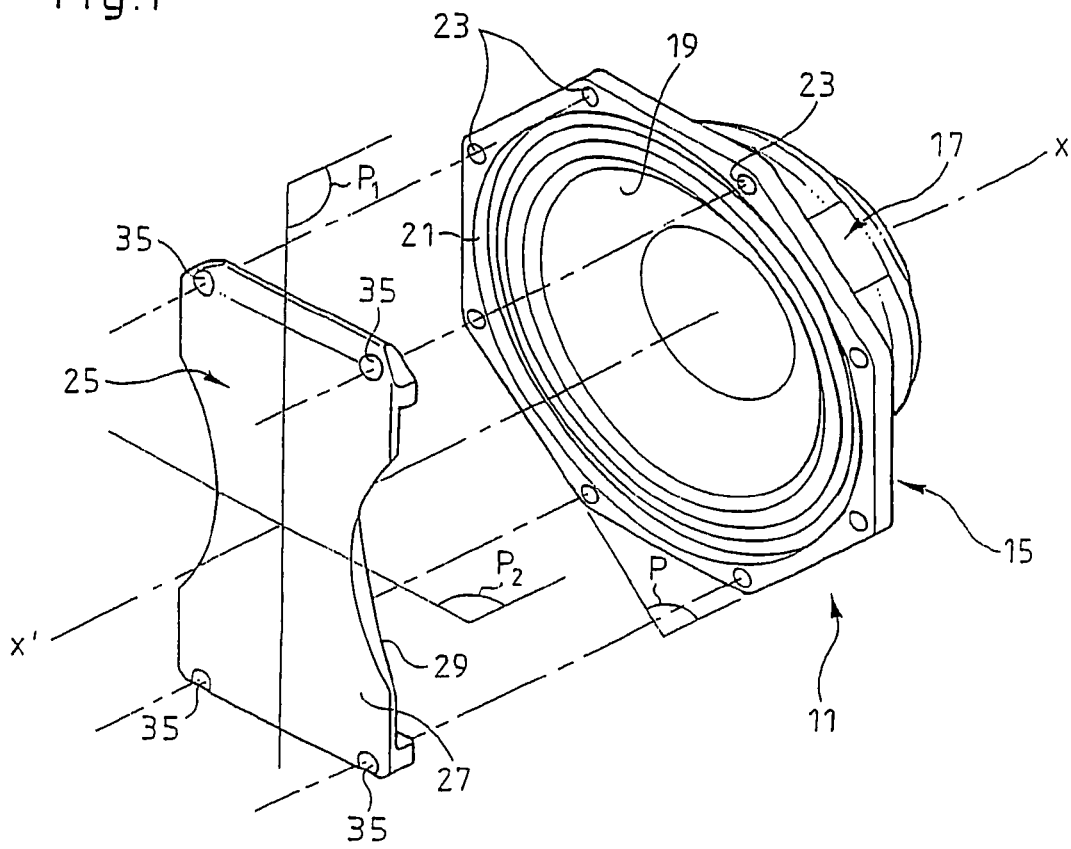
FIG. 1 is an exploded perspective view of a direct radiation loudspeaker and a directionality adapter forming a partial blocking member.

FIGS. 1 to 5 depict a conventional direct radiation loudspeaker 11 adapted to receive a blocking member 25 constituting a directionality adapter. The loudspeaker comprises a rigid chassis 15 carrying at the rear a permanent magnet 17 with a cylindrical airgap in which moves a mobile coil fastened to a mobile diaphragm 19. The outside edge of the diaphragm is attached to the rigid chassis and more particularly to a frame 21 thereof having a circular inside contour. The frame conventionally includes holes 23 for fixing the loudspeaker to an acoustic enclosure or analogous structure.

In the present context the term "acoustic emission plane" refers to the plane P containing the contour of the attachment of the diaphragm to the frame of the chassis. It is from this plane that the sound normally radiates into the air.

According to an important feature of the invention, the loudspeaker is additionally fitted with the blocking member 25 already mentioned, shaped to block only a central strip of said emission plane limited to the interior of said frame. The above use of the word "only" indicates that the blocking member is shaped (see FIG. 2) to leave two wide openings in the acoustic emission plane P, inside the frame and on respective opposite sides of the first plane of symmetry P1 containing the main axis x'x of the diaphragm, which is also the axis along which the coil moves. The shape of these two conjugate openings and the shape of the rear face of the blocking member 25 redefine or adapt the dispersion characteristics of the direct radiation loudspeaker.

The structure of the blocking member 25 is rigid. As previously indicated, it can be made from a plastics material, wood or some other material, possibly a composite material.

The material is chosen to be as inert as possible, i.e. not to be subject to unwanted vibration. As shown here, said first plane of symmetry P1 containing the axis x'x is oriented in a direction parallel to the greatest dimension of the blocked central strip. The blocking member preferably also has a second plane of symmetry P2 containing the axis x'x of the diaphragm and perpendicular to the first plane of symmetry P1. In the example shown, it has a substantially plane front face 27. On the other hand, its rear face 29, i.e. that facing toward the diaphragm 19 of the loudspeaker, is preferably profiled. For example, as shown here, said rear face is globally convex and fits into the space defined between the diaphragm 19 and the acoustic emission plane P. To be more precise, it is defined by the intersection of a convex domed surface 31 and two curved concave lateral cut-outs 33 on respective opposite sides of the first plane of symmetry P1. The two curved lateral cut-outs are symmetrical to each other with respect to said first plane of symmetry, and each cut-out is itself symmetrical with respect to said second plane of symmetry.

According to another noteworthy, although optional, feature, the domed surface 31 is substantially the same shape as the portion of the diaphragm it faces. In other words, the domed surface is at the same distance from the diaphragm at substantially all points.

The front face 27 is globally rectangular, although its median portion is narrower because of the two cut-outs 33. The blocking member has four fixing holes 35 that line up with four holes 23 in the frame of the chassis.

Figure 2:
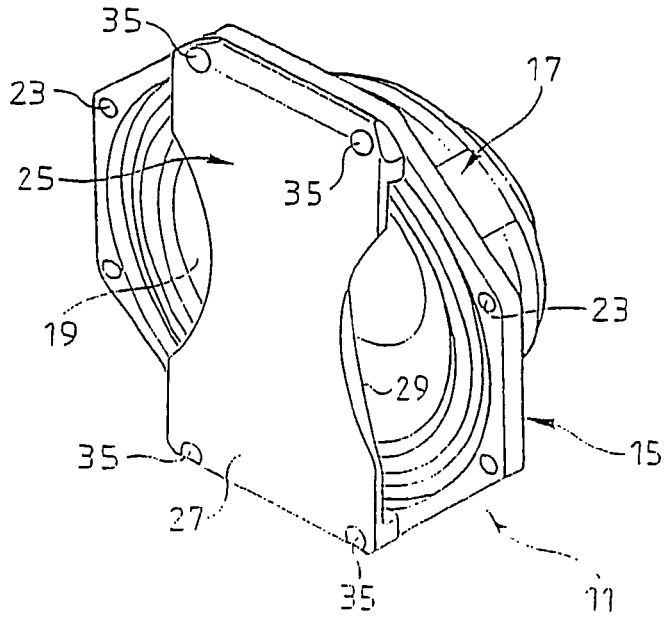
FIG. 2 is a view analogous to FIG. 1 showing the blocking member in place on the frame of the chassis of the loudspeaker.
Figure 3:
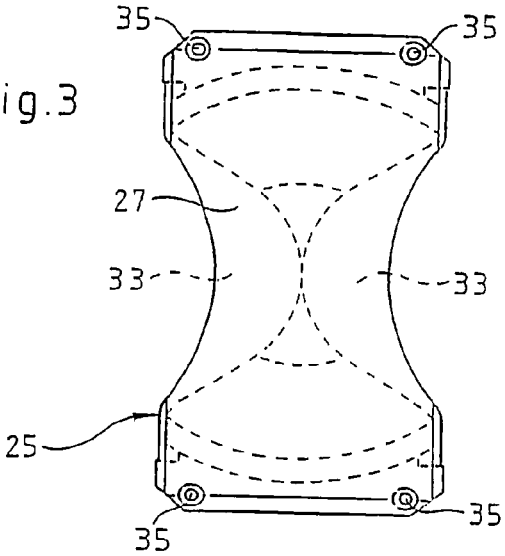
FIG. 3 is a front view of said blocking member.
Figure 4:
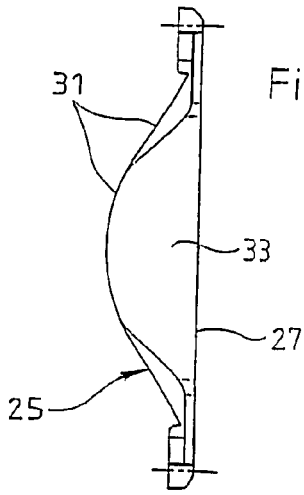
FIG. 4 is a profile view in elevation of the same blocking member.
Figure 5:
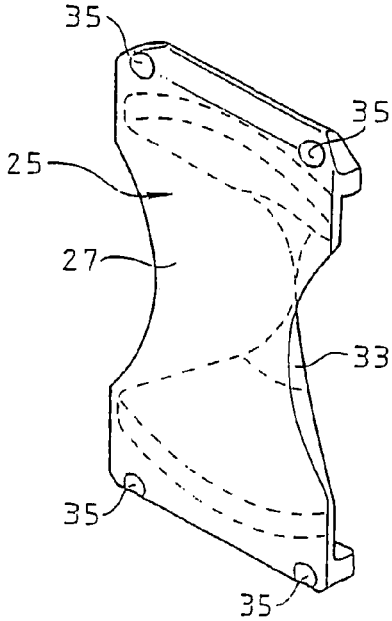
FIG. 5 is a perspective view of the blocking member.

In normal operation, the loudspeaker is disposed as shown in FIG. 2, i.e. so that the central strip covered by the blocking member 25 is substantially vertical. In this configuration, the blocking member widens dispersion in the vertical plane and reduces it in the horizontal plane. It has been found that the shape described above favorably adapts the dispersion characteristics of the loudspeaker without significantly affecting its other intrinsic performance capabilities, in particular its efficiency, maximum power input, and distortion.

As shown here, because it reduces the coverage in the horizontal plane, the blocking member enables a plurality of direct radiation loudspeakers to be coupled horizontally, eliminating interference over an extended range of frequencies.

Figure 8:
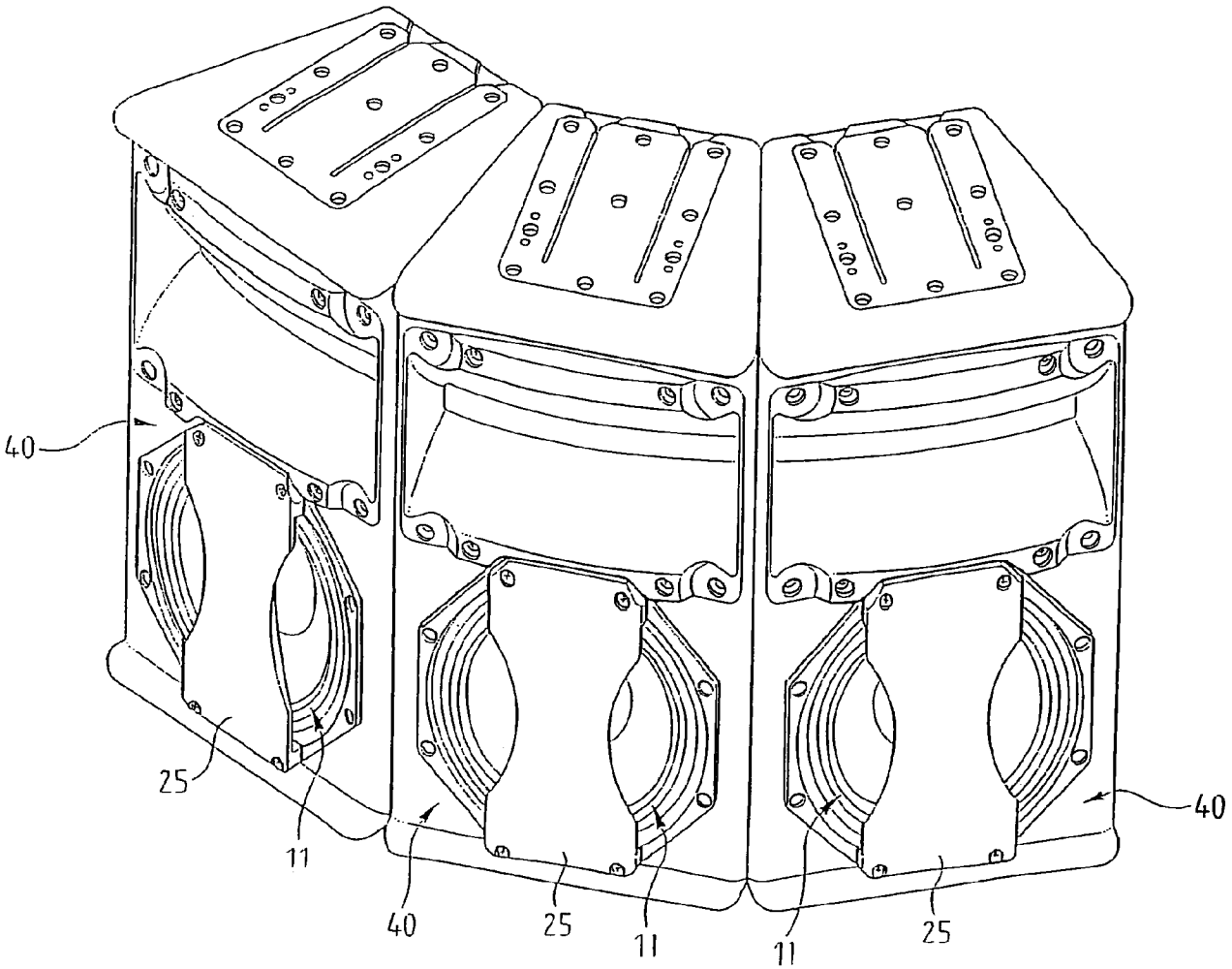
FIG. 8 shows the coupling of a plurality of loudspeakers.

FIG. 8 shows how this kind of loudspeaker 11 fitted with its blocking member 25 can be included in a dedicated acoustic enclosure 40. Each enclosure has a trapezoidal horizontal section. The acoustic enclosures are in contact via their lateral faces. This type of assembly couples the loudspeakers 11 without causing interference between them.

Figure 6:
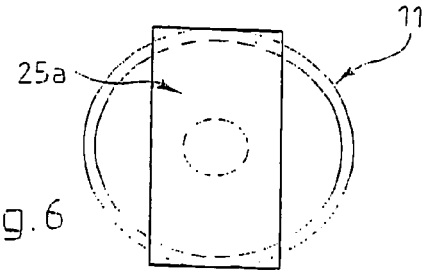
FIGS. 6 and 7 are diagrams showing alternative shapes of the blocking member.
Figure 7:
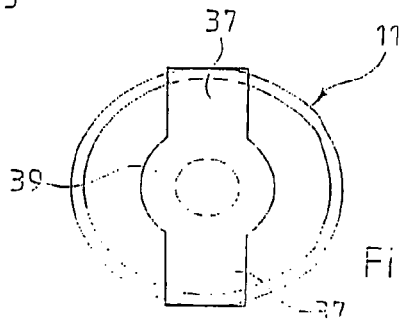

FIGS. 6 and 7 show other embodiments. In FIG. 6, the blocking member 25*a* is reduced to a very simple shape, consisting of a rectangular plate covering only a central strip of the emission plane. In the FIG. 7 embodiment, the front face consists of a combination of two rectangular portions 37 on respective opposite sides of a disk-shaped portion 39. In each of these two embodiments the rear face 29 can be plane but is preferably profiled in a comparable manner to that described with reference to FIGS. 3 to 5.

The invention claimed is:

1. A direct radiation loudspeaker comprising a mobile diaphragm, said diaphragm being attached at an outside edge to a rigid chassis, said rigid chassis forming a frame defining an acoustic emission plane, and a blocking member extending into a space between the acoustic emission plane and the diaphragm for blocking a central region of said acoustic emission plane within said frame and for defining two openings in the acoustic emission plane to respective sides of the blocking member.

2. The loudspeaker according to claim 1, wherein the blocking member has a rigid structure and a first plane of symmetry containing an axis of said diaphragm.

3. The loudspeaker according to claim 2, wherein said blocking member has a second plane of symmetry containing said axis of the diaphragm and perpendicular to said first plane of symmetry.

4. The loudspeaker according to claim 3, wherein said blocking member has a substantially plane free front face.

5. The loudspeaker according to claim 4, wherein said blocking member has a profiled rear face with opposed curved concave surfaces.

6. The loudspeaker according to claim 5, wherein said front face of the blocking member is of generally rectangular configuration, the length of the generally rectangular configuration corresponding to the diameter of the rim and the generally rectangular configuration being substantially less than the diameter of the rim.

7. The loudspeaker according to claim 6, wherein a large central portion of opposed edges of said flat front face of the blocking member is concave.

8. The loudspeaker according to claim 6, wherein said rear face is overall of convex configuration and fits in a space defined between said diaphragm and said acoustic emission plane.

9. The loudspeaker according to claim 8, wherein said rear face is defined by the intersection of a domed surface and two curved lateral cutouts lying on respective opposite sides of one of said planes of symmetry.

10. The loudspeaker according to claim 9, wherein said domed surface is substantially the same shape as a portion of the diaphragm which faces said dome surface.

11. The loudspeaker according to claim 3, wherein said blocking member has opposed curved concave sides adjacent the openings.

12. The loudspeaker according to claim 3, wherein said blocking member has a profiled rear face with opposed curved concave surfaces.

13. The loudspeaker according to claim 12, wherein said front face of the blocking member is of generally rectangular configuration, the length of the generally rectangular configuration corresponding to the diameter of the rim and the width of the generally rectangular configuration being substantially less than the diameter of the rim.

14. The loudspeaker according to claim 13, wherein a large central portion of opposed edges of said flat front face of the blocking member is concave.

15. The loudspeaker according to claim 13, wherein said rear face is overall of convex configuration and extends into the space defined between said diaphragm and said acoustic emission plane.

16. The loudspeaker according to claim 15, wherein said rear face is defined by the intersection of a domed surface and two curved lateral cutouts lying on respective opposite sides of one of said planes of symmetry.

17. The loudspeaker according to claim 16, wherein said domed surface is substantially the same shape as a portion of the diaphragm which faces said dome surface.

18. The direct radiation loudspeaker of claim 1, wherein said loudspeaker is a plurality of loudspeakers, said loudspeakers being coupled together, whereby said coupled loudspeakers eliminating eliminate interference over an extended range of frequencies compared with the same loudspeakers without said blocking members.

19. The direct radiation loudspeaker according to claim 18, wherein the blocking member has a rigid structure and a first plane of symmetry containing an axis of said diaphragm.

20. The direct radiation loudspeaker according to claim 19, wherein said blocking member has a second plane of symmetry containing said axis of the diaphragm and perpendicular to said first plane of symmetry.

21. The direct radiation loudspeaker according to claim 20, wherein said blocking member has a substantially plane front face.

22. The direct radiation loudspeaker according to claim 20, wherein said blocking member has a profiled rear face.

23. The direct radiation loudspeaker according to claim 20, wherein said front face is generally of rectangular configuration.

24. The direct radiation loudspeaker according to claim 22, wherein said rear face is overall of convex configuration and extends into the space defined between said diaphragm and said acoustic emission plane.

25. The direct radiation loudspeaker according to claim 24, wherein said rear face is defined by the intersection of a domed surface and two curved lateral cut-outs lying on respective opposite sides of one of said planes of symmetry.

26. The direct radiation loudspeaker according to claim 25, wherein said domed surface is substantially the same shape as a portion of the diaphragm which faces said dome surface.

* * * * *

UNITED STATES PATENT AND TRADEMARK OFFICE

CERTIFICATE OF CORRECTION

PATENT NO. : 7,596,236 B2
APPLICATION NO. : 10/484464
DATED : September 29, 2009
INVENTOR(S) : Eric Vincenot It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 449 days.

Signed and Sealed this

Twenty-eighth Day of September, 2010

David J. Kappos

David J. Kappos
*Director of the United States Patent and Trademark Office*